United States Patent [19]

Keiels et al.

[11] Patent Number: 4,574,961

[45] Date of Patent: Mar. 11, 1986

[54] AIRING AND DRYING FRAME

[75] Inventors: Peter Keiels, Obernhof; Dieter Patzold, Nassau, both of Fed. Rep. of Germany

[73] Assignee: Leifheit AG, Nassau/Lahn, Fed. Rep. of Germany

[21] Appl. No.: 547,198

[22] Filed: Oct. 31, 1983

[30] Foreign Application Priority Data

Jan. 13, 1983 [EP] European Pat. Off. ..... 83100226.6

[51] Int. Cl.[4] ..... D06F 53/00

[52] U.S. Cl. ..... 211/119.01; 211/96

[58] Field of Search ..... 211/119.01, 119.02, 211/119.03, 119.04–119.14, 197, 196, 118

[56] References Cited

U.S. PATENT DOCUMENTS

| | | | |
|---|---|---|---|
| 2,274,139 | 2/1942 | Goldthwait | 211/197 |
| 2,415,908 | 2/1947 | Pollard | 211/197 |
| 2,434,891 | 1/1948 | Swanson | 211/100 X |
| 2,474,922 | 7/1949 | Unwin | 211/197 X |
| 2,483,585 | 10/1949 | Lewis | 211/197 |
| 2,503,386 | 4/1950 | Griffin | 211/197 |
| 2,575,112 | 11/1951 | Kruger | 211/96 |
| 4,434,898 | 3/1984 | McCarthy | 211/119.01 X |

FOREIGN PATENT DOCUMENTS

| | | | |
|---|---|---|---|
| 2205472 | 8/1973 | Fed. Rep. of Germany | 211/119.01 |
| 2855532 | 7/1980 | Fed. Rep. of Germany | 211/119.01 |
| 8200941 | 10/1983 | Netherlands | 211/119.01 |

*Primary Examiner*—Ramon S. Britts
*Assistant Examiner*—Sarah A. Lechok Eley
*Attorney, Agent, or Firm*—Frishauf, Holtz, Goodman & Woodward

[57] ABSTRACT

An airing and drying frame with an upright mast on which a multiple-armed extending frame is fitted for accommodating individual rope polygons, the corner points of the rope polygons being attached to mutually movable slides which are mounted slidably in guideways of the arms, and wherein an actuating element for withdrawing the washing line is articulated to the outermost slide in each case.

19 Claims, 4 Drawing Figures

AIRING AND DRYING FRAME

BACKGROUND OF THE INVENTION

The invention relates to an airing and drying frame having a vertical mast on which a multiple-arm extending frame is mounted.

These so-called washing umbrellas, are known, for example, from Swiss Pat. No. 390,863 and are extremely popular as airing and drying devices for garments and laundry. They permit a large quantity of garments and laundry items to be hung up in a small space. Even large items such as bed linens and tablecloths present no problems. Clothes line lengths up to 70 meters are not uncommon. These appliances have the particular advantage that they can be stored folded in a very small space when not in use. However, the disorderly hanging of the clothes line in the folded state is a disadvantage of these washing umbrellas. The clothes line can easily become tangled and can become soiled.

SUMMARY OF THE INVENTION

An object of the present invention is to produce an airing and drying frame with a clothes line withdrawing device, whereby the clothes line is automatically withdrawn into the arms when the frame is folded together, while exerting the smallest possible force and without additional spring elements in the arms of the extending frame.

Another object of the present invention is the provision of an improved air drying frame at a production cost comparable to the current airing and drying frames.

An additional object is ease of production of the frame according to this invention.

A still further object is the provision of an airing and drying frame which does not necessitate any additional manual actions during operation.

In pursuance of these objects, one feature of the present invention resides in the provision of a frame for airing and drying articles comprising support means; a plurality of arms extending from the support means; means extending from the arms for hanging articles; and means connected to the arms and the support means for retracting the hanging means into the arms. The assembly outlay is reduced by dividing the clothes line into closed individual rope polygons. The rope poygons are secured to individual slides. However, the withdrawal of the clothes line can occur after actuating only the outermost slide. This makes the outlay for adjusting members in the arm small.

Thus, by the dimensional coordination of the slides, the rope polygon sections and the actuating elements with springs, the folding together and erecting of the extending frame proceeds particularly easily and simply, and the washing line is withdrawn tautly into the arms in the folded state.

A further simplification of assembly is achieved by the construction of the arms as profiles open on one side with a segment cover. The rope polygons can, therefore, be assembled into perforations or holes without any threading-in operations. Errors of assembly are excluded. A high degree of pre-fabrication can, therefore, be achieved.

As a further development of the invention, this ease of assembly is further enhanced by the particular construction of the slide. Ease of movement in the guideways is also achieved.

BRIEF DESCRIPTION OF THE DRAWING

Above-mentioned and other features and objects of this invention will become more apparent by reference to the following decription taken in conjunction with the accompanying drawing(s), in which.

DESCRIPTION OF THE PREFERRED EMBODIMENT

Figure 1:
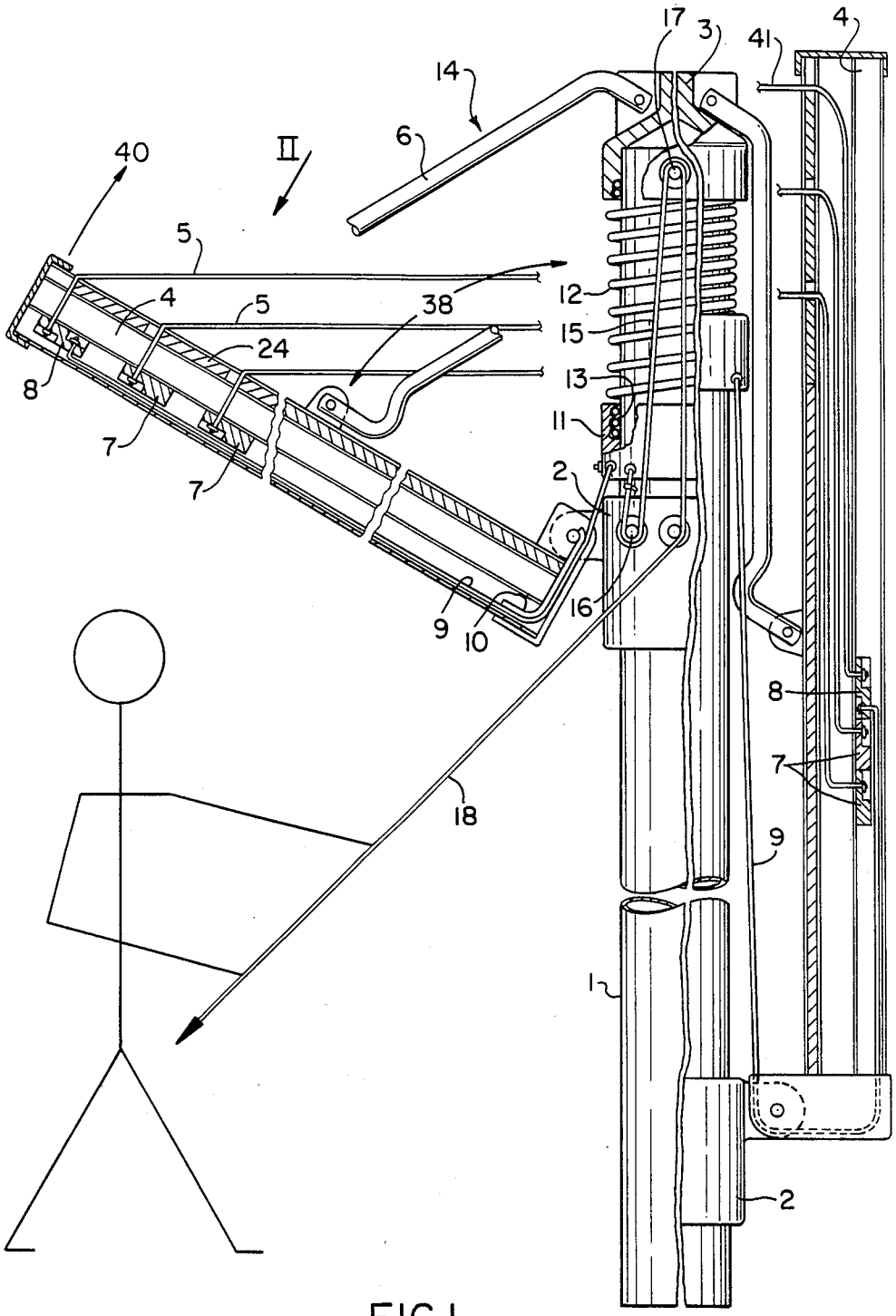
FIG. 1 shows a partly sectional view of the airing and drying frame with the left-hand half in an extended position and the right-hand half closed.
Figure 4:
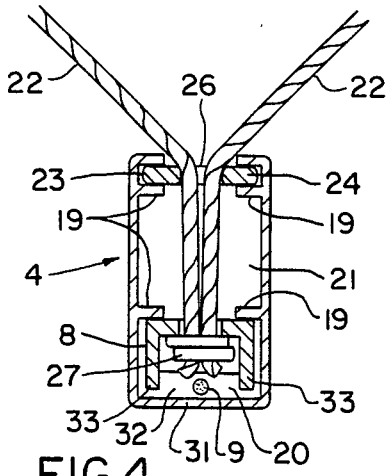
FIG. 4 shows a section along the line IV—IV in FIG. 2.
Figure 2:
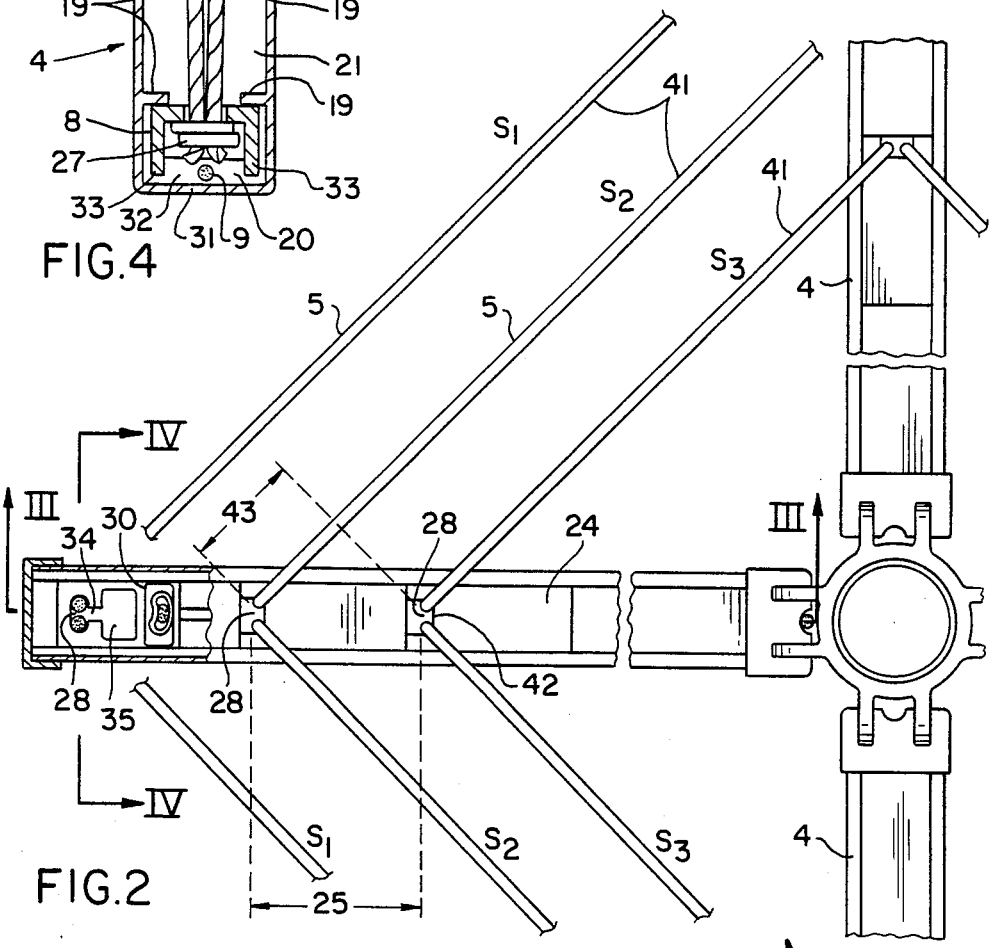
FIG. 2 is a top view taken in the direction II of FIG. 1.
Figure 3:
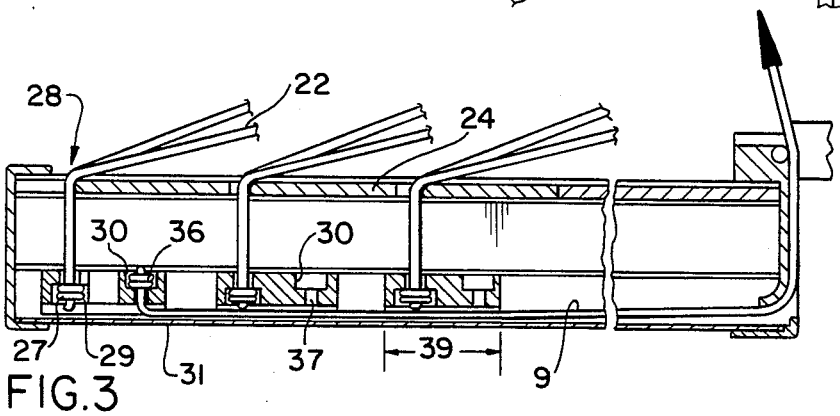
FIG. 3 is a sectional view taken along the line III—III in FIG. 2.

A mounting spider 2 is mounted slidable but lockably relative to a fixed point 3 on a mast 1. Arms 4, between which rope polygons 5 are tensioned, are mounted pivotally on the mounting spider 2. They are braced relative to the fixed point 3 by extending arms 6. The individual rope polygons 5 are articulated to a slide 7 in the interior of the arms 4 in each case. The outermost slide 8 in each case is connected to an actuating element 9 which is passed via a return rail 10 in the arm 4 to a sliding ring 11. The sliding ring 11 is braced against the fixed point 3 with inter-position of a spring 12. Both the fixed point 3 and the sliding ring 11 are provided with a female screw-thread 13 into which the spring 12 is screwed.

In order to open the extending frame 14, which consists of the arms 4 and of the extending arms 6, a traction cable 15 is attached to the sliding ring 11, passing from the sliding ring 11 via a return means 16 in the mounting spider 2, to a further return means 17 in the fixed point 3 back to the mounting spider 2. An actuating end 18 is brought out from the latter.

The arms 4 consist of a box-shaped profile open on one side. It is divided by longitudinal ribs 19 into a sliding shaft 20, which serves as the guideway for the slides 7, a clothes line shaft 21 for the clothes line 22, and a shaft 23 for the segment covers 24. The segment covers 24 have the length of the rope polygon interval 25 of two adjacent rope polygons and are provided at the end with a perforation 26 for the clothes line 22.

The clothes line 22 is construction in the form of individual rope polygons 5. These rope polygons 5, when laid out on the ground, have the form of squares and are provided with a clamp 27 at their corner points 28. The corner points 28 of the individual rope polygons 5 are hooked by this clamp 27 in housings 29 of the slides 7. The actuating element 9 is hooked in a further housing 30 in the outermost slide 8. The actuating element 9 is guided between the rear wall 31 of the profile and the slide 7 in a channel 32. The slide 7 is provided with two sliding elevations 33. A slot 34, which opens into a broadened introduction aperture 35, is provided to retain the clamp 27. The actuating element 9 is retained in the housing 30 by means of a knot 36 and is passed through a hole 37 into the channel 32.

The cycle of movements when actuating the airing and drying frame is described below with reference to FIG. 1. Starting from the closed position, by pulling on the actuating end 18 of the traction cable 15, the sliding ring 11 moves downwards due to the counteraction by the actuating element 9. The spring 12 then becomes tensioned. The downward movement of the sliding ring, with simultaneous tensioning of the spring 12, is caused by the relatively long adjustment stroke of the clothes line 22 compared to the stroke of the mounting spider 2 on the mast 1. After a certain extension angle 38, the relative movement of the clothes line 22 to the mounting spider 2 is reversed and the sliding ring 11 is drawn upwards again by the spring 12, where it supports the extending movement of the arms 4 and tensions the clothes line 22 or the rope polygons 5. The spring 12 accordingly performs two functions; it supports the opening operation and equalizes the relative movement between mounting spider 2 and actuating element 9 or clothes line 22 respectively.

When closing the airing and drying frame, the mounting spider 2, which is anchored to the mast 1 by a bolt, not shown, is unbolted. The closing operation is initiated by pivoting the arms 4 in the direction 40. Then, in the first phase of the closing operation, the stroke of the mounting spider 2 on the mast is longer than the withdrawal of the washing line. The sliding ring 11 moves downwardly by tensioning the spring 12. Again, the relative movement is reversed only after a specific extension angle 38. The withdrawal of the rope polygons 5, commencing with the outermost rope polygon S1, by the actuating element commences. The outermost slide 8 commences to travel inwardly and entrains the next slide 7. The withdrawal of the rope polygon S2 commences and triggers the withdrawal of the rope polygon S3 after the slide 7 again loads the next slide. The inward pivoting of the arms 4 is assisted by the tensioning force of the spring 12. In the closed state of the extending frame 14, the slides are closely juxtaposed; the clothes line, or the sections 41 of the rope polygons 5 located round the mast, are taut.

In order to have all the sections 41 located round the mast 1 uniformly taut, the slides 7, 8 must each have a length 39 which corresponds to have the difference in length 43 of two adjacent rope polygon sections, for example S2–S3.

The interval of the innermost acticulation point 42 of the innermost rope polygon from the mast 1 corresponds to half the length of the rope polygon section S3 plus the length 39 of a slide 7. The slides 7, 8 all have the same length for an equal rope polygon interval 25 of the individual rope polygons 5.

While we have described above the principles of our invention in connection with specific apparatus, it is to be clearly understood that this description is made only by way of example and not as a limitation to the scope of our invention as set forth in the objects thereof and in the accompanying claims.

We claim:

1. A frame for airing and drying articles comprising:

support means;

a plurality of arms extending from said support means;

hanging means extending from said arms for hanging the articles, said hanging means including at least one closed polygon rope which is connected to each of said arms at locations on said rope; and retracting means connected to said arms and said support means for retracting said hanging means into said arms, said retracting means including at least one sliding element movably mounted in each of said arms and to which said locations are connected to constitute a first unit therewith.

2. The frame as claimed in claim 1 wherein said locatins on said rope are equidistant.

3. The frame as claimed in claim 1 further including a second unit including a sliding element movably mounted in said arms, said second unit being arranged closer to said support means than said first unit when said arms are in an open position.

4. The frame as claimed in claim 3 wherein the length of each of said sliding elements of said units is equal to half the difference in length between two adjacent units.

5. The frame as claimed in claim 3, wherein the distance between two adjacent locations on either one of said units coonstitutes a section and wherein the distance between said second unit and said support means is equal to half the length of one of said sliding elements of said second unit plus the length of said section of said second unit.

6. The frame as claimed in claim 1, wherein each of said arms is a substantially U-shaped member and includes cover elements located on the open portion thereof, each of said cover elements having portions which bound an opening through which said rope extends for connection to said sliding element.

7. The frame as claimed in claim 1, wherein each of said arms includes a plurality of spaced-apart rib sections extending along the interior length thereof.

8. The frame as claimed in claim 1 wherein the support means includes a central vertical mast and extension elements rotatably mounted at their upper portions to said mast and at their lower portions to said arms.

9. The frame as claimed in claim 8, wherein said retracting means further includes a sliding ring positioned around said mast and actuating elements, each of which is attached to said sliding ring at one end and to said sliding element of said first unit at the other end, and an actuating portion attached to said sliding ring at one end and having the other end free.

10. The frame as claimed in claim 9 wherein said retracting means further includes a spring positioned concentrically around said mast and being secured at its lower portion with said sliding ring and at its upper portion with the top portion of said mast.

11. The frame as claimed in claim 9 wherein said sliding elements of said first unit are each provided with a first housing for the attachment of the actuating element and with a second housing for the attachment of clothes lines.

12. The frame as claimed in claim 3 wherein said sliding element has a U-shaped cross-section.

13. A frame for airing and drying of articles comprising:

a vertical mast;

a plurality of arms extending from said mast, each of said arms including a guideway and a first and a second movable slide mounted in said guideway, said second slide being positioned closer to said vertical mast than said first slide;

a first clothes line attached to said first slide in each of said arms and being in the shape of a closed rope polygon;

a second clothes line attached to said second slide in each of said arms and being in the shape of a closed rope polygon;

means for withdrawing said first and said second clothes line into said arms when said arms begin a closing operation; and an actuating element connected to said first slide in each of said arms for extending the arms into an open position.

14. A frame for airing and drying articles comprising:

support means;

a plurality of arms extending from said support means;

hanging means extending from said arms for hanging the articles; and retracting means connected to said arms and said support means for retracting said hanging means into said arms, said retracting means including at least one sliding element movably mounted in each of said arms and to which said locations are connected to constitute a first unit therewith;

each of said arms being a substantially U-shaped member having open portions and each arm including cover elements located on the open portion thereof, each of said cover elements having portions which bound an opening through which said rope extends for connection to said sliding element.

15. A frame for airing and drying articles comprising:

support means;

a plurality of arms extending from said support means:

said support means including a central vertical mast and extension elements rotatably mounted at their upper portions to said mast and at their lower portions to said arms;

hanging means extending from said arms for hanging the articles; and retracting means connected to said arms and said support means for retracting the hanging means into said arms, said retracting means including at least one sliding element movably mounted in each of said arms and coupled to said hanging means to constitute a first unit therewith;

said retracting means further including a sliding ring positioned around said mast; actuating elements, each of which is attached to said sliding ring at one end and to said sliding element of said first unit at the other end, and an actuating portion attached to said sliding ring at one end and having the other end free; and a spring positioned concentrically around said mast and being secured at its lower portion with said sliding ring and at its upper portion with the top portion of said mast.

16. The frame as claimed in claim 15 wherein said sliding elements of said first unit are each provided with a first housing for the attachment of the actuating element and with a second housing for the attachment of clothes lines.

17. An airing and drying frame comprising:

a vertical mast;

a frame mounted to said mast and having a plurality of arms extending therefrom and on which a washing line is mounted, said arms being foldable toward said mast, said frame including means for withdrawing said washing line into said arms when the extending arms of said frame are folded together;

said arms having guideways therein and in which a plurality of movable slides are slidably mounted;

said washing line comprising at least first and second closed rope polygons, the corner points of which are attached to said movable slides; and an actuating element articulatedly coupled to the outermost slide of each arm for withdrawal of said washing line into said arms when said arms are folded toward said mast.

18. An airing and drying frame as claimed in claim 17, wherein the length of each slide corresponds to half the difference in length of two adjacent rope polygon sections.

19. An airing and drying frame as claimed in claim 18, wherein the distance between the innermost articulation point of the innermost rope polygon from the mast corresponds to half the length of the rope polygon section plus the length of the innermost slide.

* * * * *